United States Patent [19]

Aust

[11] 4,408,710

[45] Oct. 11, 1983

[54] CARTON HAVING TEAR RESISTANT HAND HOLES

[75] Inventor: John J. Aust, Toledo, Ohio

[73] Assignee: Owens-Illinois, Inc., Toledo, Ohio

[21] Appl. No.: 273,131

[22] Filed: Jun. 12, 1981

[51] Int. Cl.[3] ..... B65D 5/46; B65D 5/48; B65D 25/28

[52] U.S. Cl. ..... 229/15; 229/52 B

[58] Field of Search ..... 229/15, 52 B, 27

[56] References Cited

U.S. PATENT DOCUMENTS

| | | | |
|---|---|---|---|
| 1,790,119 | 1/1931 | Stevens | 229/15 |
| 1,974,527 | 9/1934 | Bliss | 229/15 |
| 2,192,412 | 3/1940 | Reaume | 229/15 |
| 2,611,527 | 9/1952 | Fisher | 229/52 B |
| 2,718,301 | 9/1955 | Palmer | 229/52 B |
| 3,258,188 | 6/1966 | Houston | 229/15 |
| 3,348,667 | 10/1967 | Beeby | 229/15 |
| 3,433,401 | 3/1969 | Swift | 229/15 |
| 3,797,731 | 3/1974 | Weldon | 229/52 B |
| 3,921,893 | 11/1975 | Randle | 229/15 |
| 4,046,307 | 9/1977 | Booth | 229/15 |
| 4,164,312 | 8/1979 | Harned | 229/15 |
| 4,177,895 | 11/1979 | Shelton | 229/15 |
| 4,186,846 | 2/1980 | Jacalone | 229/15 |
| 4,262,837 | 4/1981 | Fremion | 229/15 |
| 4,293,091 | 10/1981 | Gerard | 229/15 |

FOREIGN PATENT DOCUMENTS

| | | | |
|---|---|---|---|
| 854573 | 10/1970 | Canada | 229/52 B |

*Primary Examiner*—Herbert F. Ross

*Attorney, Agent, or Firm*—J. R. Nelson; M. E. Click

[57] ABSTRACT

The invention relates to improved finger hole construction for lifting a two cell box. The divider in the box is formed by two abutting vertical panels and finger holes are respectively cut from side walls integrally formed with each said panel and in vertically aligned relationship, the horizontal width of the finger holes being limited to accommodate only two adult fingers so that the insertion of four fingers into the two aligned holes results in a division of the lifting force between the two side walls and tearing is resisted by the close proximity of the integral vertical panels to the point of application of the lifting force.

2 Claims, 4 Drawing Figures

CARTON HAVING TEAR RESISTANT HAND HOLES

BACKGROUND OF THE INVENTION

In recent years, it has become common practice to employ corrugated cartons for the multi-packing of relatively large containers of soft drinks, juices, household chemicals and the like. In contrast to returnable beverage bottles, the containers now employed are the so-called "one-way" or single trip containers, and it necessarily follows that there is no requirement that the cartons in which such containers are carried by the consumer from the supermarket to his home be capable of repeated usage. Economics therefore dictate that such cartons be made with as little corrugated board incorporated in their construction as is possible.

At the same time, such cartons, when filled, are relatively heavy and difficult for the average consumer, and particularly women and elderly consumers, to conveniently lift and transport. It is therefore desirable to provide hand holes in each of two opposed side walls of the corrugated container. When such side walls are fabricated from relatively light weight board, consistent with the limited strength and life requirements of the carton, the tearing of such hand holes often results. This is particularly true due to the habit of many consumers of inserting only one hand in one of the hand holes and supporting the entire weight of the container by such hand hole.

There is, therefore, a definite need for a light weight corrugated carton having improved hand holes which will effectively resist tearing of the side walls of the container when the entire weight of the container and contents is suspended from a single hand hole.

SUMMARY OF THE INVENTION

This invention provides an improved hand hole construction for light weight corrugated cartons which are required to transport relatively heavy contents. A two cell corrugated carton is provided having a pair of abutting vertical divider panels. Each such divider has flaps extending at right angles to the main portion of the divider. Such flaps are secured to, or form a major portion of the side wall of the carton, so that at least the central portions of such divider flaps are exteriorly exposed. Hand holes are then formed by cutting two halves of a hand hole in aligned adjacent relationship respectively in the adjacent flaps of the divider members. The hand holes thus produced are limited in lateral extent so that the insertion of all four fingers in any one of the half hand holes is effectively prevented and the inherent result is that the consumer inserts two fingers in each of the two aligned half hand holes and thus divides the carrying load between both of the vertical divider members.

The uppermost corners of such half hand holes are provided with a fillet of a substantial radius to further increase the resistance of the material above the hand hole to a tearing action. Equally important, the material removed for each half hand hole is not completely cut from the corrugated panel but instead an upwardly and inwardly directed flap is produced by insertion of the fingers, which is secured along its upper side to the main flap portion of the divider, thus providing protection to the consumers fingers from contact with the cut edges of the corrugated board when applying a lifting force to the carton.

Further objects and advantages of the invention will become readily apparent to those skilled in the art from the following detailed description, taken in conjunction with the annexed sheets of drawings on which, by preferred example only, are illustrated several embodiments of the invention.

DESCRIPTION OF THE PREFERRED EMBODIMENTS

Figure 1:
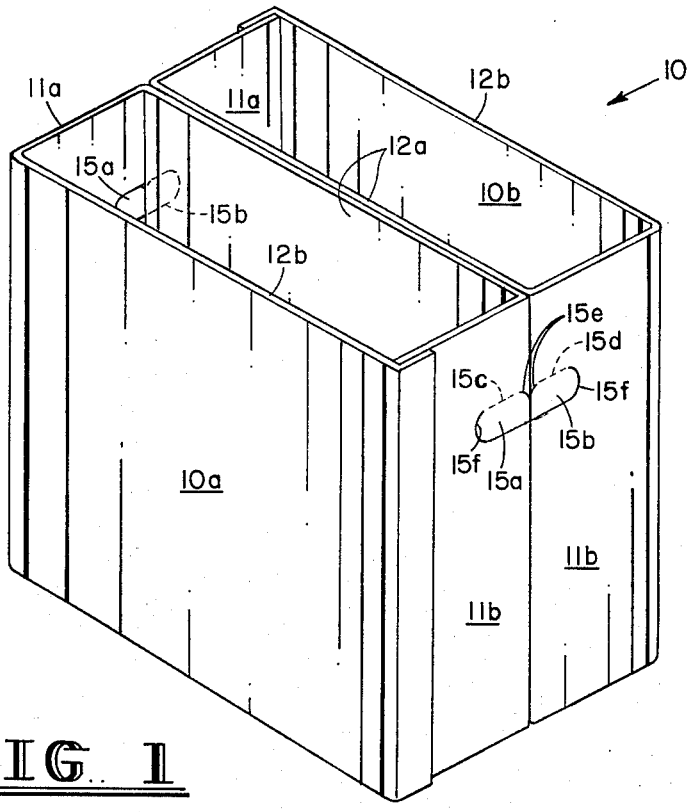
FIG. 1 is a schematic perspective view illustrating a corrugated carton incorporating the principles of this invention wherein two half cartons are secured together to form a two cell carton having a double wall central vertical partition.

Referring to FIG. 1, the principle of this invention may be readily understood when considering a carton 10 formed by the side by side securement of two half cartons 10*a* and 10*b* respectively. Each half carton is folded from a corrugated blank in conventional fashion and incorporates a bottom wall (not shown), two vertically disposed end walls 11*a* and 11*b* and two vertically disposed, horizontally spaced side walls 12*a* and 12*b*. Side walls 12*a* of each half carton are placed in abutment and rigidly secured together by adhesive or stapling, thus dividing the interior of the carton into two cells.

Figure 4:
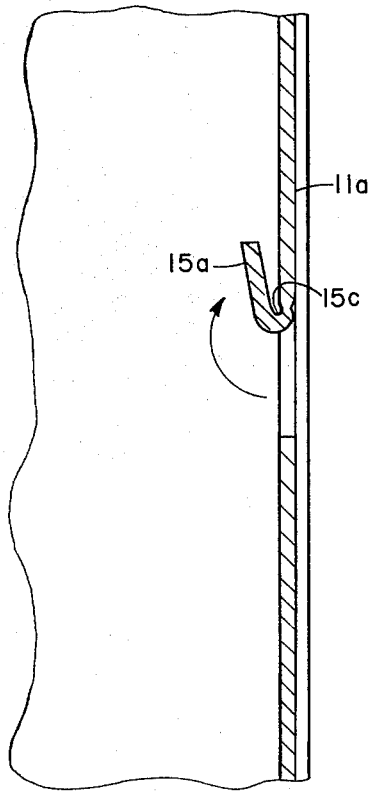
FIG. 4 is a vertical sectional view through one of the hand holes constructed in accordance with this invention.

The hand holes embodying the invention are incorporated in this box construction by slitting a generally quarter-oval shaped cut in each of the end walls 11*a* and 11*b* and scoring above the cut, thus producing a pair of flaps 15*a* and 15*b* on each side of box 10, with such flaps being disposed in vertical alignment and being secured for an inward and upward pivotal movement (FIG. 4) to the remainder of the respective end walls by an integral fold line 15*c* and 15*d*. The horizontal dimensions of each flap 15*a* and 15*b* is limited so as to permit not more than two adult fingers to be inserted in the respective hole formed by pivoting the flap inwardly, thus making the most natural way to grasp the hand hole by the insertion of two fingers each in the respective half hand holes. This insures that the lifting forces are not confined to a single vertical wall portion of the box but instead are distributed to the two partition forming side wall portions 12*a* and are further reinforced against splitting by the vertical fold between end walls 11*a* and 11*b* and the side walls 12*a*. Additionally, each of the slits cut into the side walls 11*a* and 11*b* is provided with a fillet 15*e* and 15*f* in each of the upper corners to further increase the resistance of the corrugated board to tearing by the lifting forces exerted thereon.

From the foregoing description, it will be readily apparent that when the flaps 15*a* and 15*b* are pushed inwardly and upwardly (FIG. 4), or occasionally, outwardly and upwardly, they automatically provide protection for the fingers of the consumer inserted in the slots thus defined by the removal of the flaps 15*a* and 15*b*. The fingers of the consumer do not come in contact with the raw cut edge of the corrugated board when exerting a lifting force on the carton.

Figure 2:
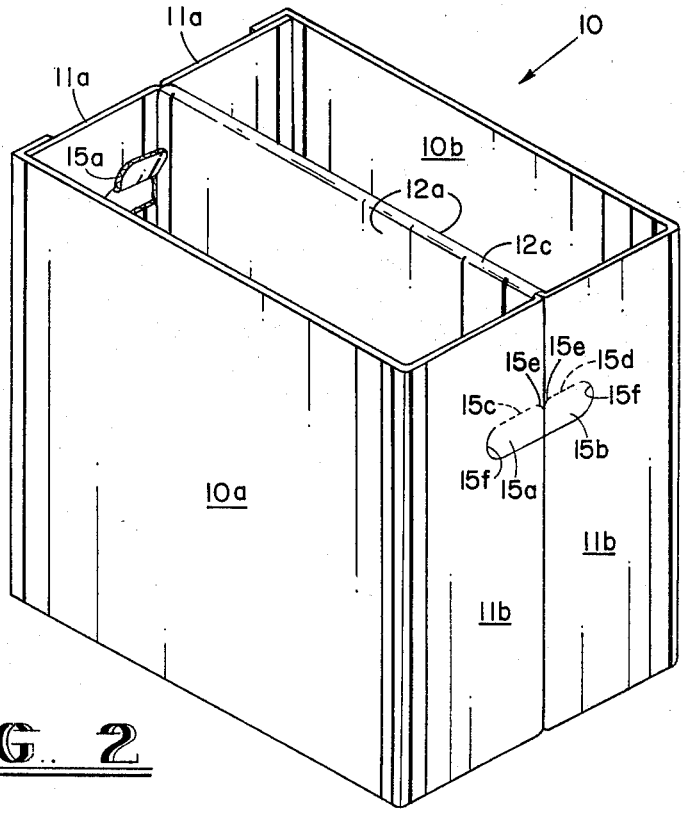
FIG. 2 is a schematic perspective view of a carton construction similar to FIG. 1 but wherein the entire carton is fabricated from a single sheet of corrugated board and the central divider walls are integrally united at their top.

Referring now to FIG. 2, wherein similar numbers indicate the same components as in FIG. 1, the only difference is that both half box portions 10*a* and 10*b* are formed from a single sheet of corrugated material and thus the wall divider portions 12*a* are integrally united by a fold line 12*c* provided at the top of such wall portions.

Figure 3:
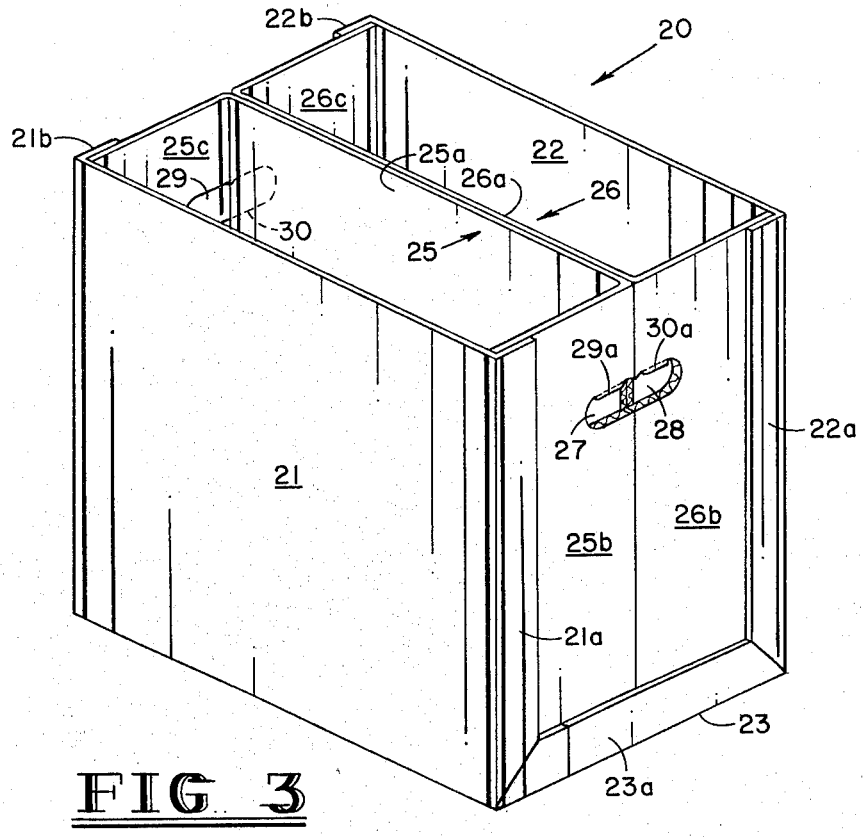
FIG. 3 is a perspective view of still another form of carton embodying this invention wherein two of the side walls of the carton are formed with skeletonized peripheral portions and the central portions of such side walls, including the hand holes, are formed by dividers constructed in accordance with this invention.

Referring now to FIG. 3, there is shown a further modification of this invention wherein the box 20 is fabricated from three separate pieces of corrugated board. One die cut sheet of board forms side walls 21 and 22 of the box 20 as well as the bottom wall 23. Integrally secured to each of the side walls 21 and 22 and to the bottom wall respectively are skeleton flap portions 21*a*, 22*a* and 23*a* which are folded at ninety degrees to their respective wall portions and thus define a generally U-shaped shell. The box is completed by inserting two identical U-shaped partition or divider elements 25 and 26 within the shell defined by the upstanding walls 21 and 22.

The divider elements 25 and 26 are U-shaped in a horizontal plane and have their central vertical wall portions 25*a* and 26*a* in abutment. Such wall portions may or may not be secured together. The arm portions 25*b* and 25*c* of divider element 25 have their peripheral edges secured by adhesive or staples to the flaps 21*a* and 21*b* formed on the side wall 21. In like manner the arm portions 26*b* and 26*c* of divider element 26 have their extremities similarly secured to the flange portions 22*a* and 22*b* of the box side wall 22. The bottom flaps 23*a* are secured to the bottom of the divider arm portions 25*b*, 25*c*, 26*b* and 26*c* that are in abutment therewith. Thus, a very rigid two cell box construction is provided having a central divider defined by the abutting central portions 25*a* and 26*a* of the U-shaped dividers 25 and 26.

Hand holes, or more properly, finger holes 27 and 28 are provided in the exposed portions of the divider arms 25*b*, 25*c* and 26*b* and 26*c*. As in the previous modifications, the horizontal length of each finger hole opening is limited to permit only the insertion of two adult fingers in each opening, thus guiding the consumers hand so that two fingers are placed in each of the horizontally aligned half hand holes and the lifting force is applied to both of the partition elements 25 and 26. The finger holes 27 and 28 are respectively defined by the cutting out of flaps 29 and 30 which are integrally secured along their top edges 29*a* and 30*a* to the side wall portions of the dividers 25 and 26. The top corners of the cut or scores produced in the side wall portions 25*b*, 25*c*, 26*b*, and 26*c* to define the flaps 29 and 30, all have their upper corners formed with a generous fillet to further reduce the possibility of tearing the corrugated material through the application of a lifting force to the hand holes.

Those skilled in the art will recognize that the divider elements 25 and 26 may be fabricated as a single piece by integrally joining the top or bottom edges of wall portions 25*a* and 26*a* by a fold.

From the foregoing description, those skilled in the art will recognize that the principles of this invention may be applied to a large number of carton constructions. The fundamental principle is the distribution of the lifting forces normally applied by the fingers of a consumer handling the carton so that the force is divided between two separate corrugated wall elements and, preferably, the divided force is applied in the vicinity of a vertical fold line in each of the corrugated wall elements. Modifications of this invention are therefore believed to be readily apparent to those skilled in the art and it is intended that the scope of the invention be determined solely by the appended claims.

What is claimed is:

1. In a rectangular box including two opposed end walls, two opposed side walls extending between opposite ends of said end walls and a divider wall extending between said side walls, thereby dividing the interior of the box into two compartments, the improvement wherein:

(a) said divider wall and side walls comprise a pair of U-shaped vertically disposed corrugated panels each having a central portion and arm portions, integral with said central portion, extending from opposite ends of said central portion, the central portions of said pair of U-shaped panels abutting to form said divider wall and said arm portions extending at right angles in opposite directions from the respective of said central portions and joined to the respective opposite ends of said end walls, the pair of arm portions at each end of said divider wall forming the respective of said side walls; and (b) each of said pair of arm portions, forming an end wall, having a pair of contiguous finger insertion openings, one of said openings being in each arm portion immediately adjacent to the respective central portion, said finger insertion openings being aligned and each limited in size to permit insertion of only two adult fingers therein, each said opening being formed with a fillet of a substantial radius provided at the upper corner of each opening adjacent the respective central portion, said fillet bridging said arm portion and said central portion, and said central portion extending from said fillet at a right angle to reinforce said fillet and said finger insertion opening against tearing.

2. The box improvement of claim 1 wherein each of said finger insertion openings are provided by a flap formed in the end wall defined by a cut on three sides and a foldable side located at the upper edge of said flap for folding the flap upwardly and inwardly therealong, said folded flap reducing contact of the inserted fingers with a cut edge of the side wall.

* * * * *